US008759650B2

(12) United States Patent
Deering et al.

(10) Patent No.: US 8,759,650 B2
(45) Date of Patent: Jun. 24, 2014

(54) BANJO BRIDGE BASE PLATE

(75) Inventors: Charles G. Deering, El Cajon, CA (US); Jens H. Kruger, North Wilkesboro, NC (US)

(73) Assignee: Deering Banjo Co., Inc., Spring Valley, CA (US)

( * ) Notice: Subject to any disclaimer, the term of this patent is extended or adjusted under 35 U.S.C. 154(b) by 0 days.

(21) Appl. No.: 13/472,162

(22) Filed: May 15, 2012

(65) Prior Publication Data

US 2012/0291608 A1 Nov. 22, 2012

Related U.S. Application Data

(60) Provisional application No. 61/486,564, filed on May 16, 2011.

(51) Int. Cl.
*G10D 3/04* (2006.01)

(52) U.S. Cl.
USPC ..... 84/308; 84/298

(58) Field of Classification Search
USPC ..... 84/308, 298
See application file for complete search history.

(56) References Cited

U.S. PATENT DOCUMENTS

| | | | | | |
|---|---|---|---|---|---|
| 516,427 | A * | 3/1894 | Bent | 84/269 |
| 566,835 | A * | 9/1896 | Ahlstrand | 84/298 |
| 786,625 | A * | 4/1905 | Callan | 84/308 |
| 974,053 | A * | 10/1910 | Griffis | 84/308 |
| D228,673 | S * | 10/1973 | Rendell | D17/21 |
| 2012/0291608 | A1 * | 11/2012 | Deering et al. | 84/308 |

* cited by examiner

*Primary Examiner* — Robert W Horn
(74) *Attorney, Agent, or Firm* — Richard D. Clarke

(57) ABSTRACT

The present invention is directed to a banjo bridge base plate, constructed of natural wood in a simple rectangle shaped form, or an irregular or fancy decorative shaped form, or constructed from various other materials, including synthetic wood, plastics, ebony, ivory, pearl and like materials, or combinations thereof, that will achieve the a similar operational effect, that effect being to confer upon a banjo so equipped with improved tonal quality.

20 Claims, 3 Drawing Sheets

BANJO BRIDGE BASE PLATE

FIELD OF THE INVENTION

The present invention is directed to a banjo bridge configuration, and more particularly to a banjo bridge base plate formed in a rectangular or irregular shape and located between the banjo drum head surface and the banjo bridge, whereby the inclusion of this banjo bridge base acts to produce an improved overall tonal quality from the banjo instrument.

BACKGROUND OF THE INVENTION

The banjo is a stringed instrument with, typically, four or five strings, which vibrate a membrane of plastic material or animal hide stretched over a circular frame. The banjo is usually associated with country, folk, classical music, Irish traditional music and bluegrass music. Recently, the banjo has enjoyed inclusion in a wide variety of musical genres, including pop crossover music, indie rock and Celtic punk.

The modern banjo comes in a variety of forms, including four- and five-string versions. A six-string version, tuned and played similarly to a guitar, has gained popularity. In almost all of its forms, banjo playing is characterized by a fast arpeggiated plucking, though there are many different playing styles.

The body, or "pot," of a modern banjo typically consists of a circular rim (generally made of wood, though metal was also common on older banjos) and a tensioned head, similar to a drum head. Traditionally the head was made from animal skin, but today is often made of various synthetic materials. Most modern banjos also have a metal "tone ring" assembly that helps further clarify and project the sound, however many older banjos did not include a tone ring.

Modern banjos are typically strung with metal strings. Usually the fourth string is wound with either steel or bronze-phosphor alloy. Some banjo players may string their banjos with nylon or gut strings to achieve a more mellow, old-time tone.

One of the most critical parts of a banjo is the bridge. Varying the banjo bridge can vary the sound quality and sound character or tone of a banjo. The mass of the bridge is extremely important for proper banjo tone production, and this is a primary purpose of proper banjo setup. A heavy bridge will mute the instrument, and for this reason, many experienced banjo players routinely remove excess wood from bridges with a Dremel Mototool® or the like. This will increase the volume and brighten the sound. Some banjo players do not usually find it necessary to alter these bridges by removing any wood from them. The bridge on a banjo is not permanently attached to the head, so it is possible for a bridge to move out of position.

The reason for banjo bridges having openings is to cut down on the mass of the bridge. Heavier bridges make for a mellower tone. Very light bridges make a bright sound. Most banjo players and builders already know it takes a very heavy (dense wood) to give a good banjo sound. Maple has been traditionally used to construct banjo bridges, but it has to be shaved very thin to compensate for the inherent heaviness of the wood. The reason for breaking the banjo bridge into separate feet is to allow the bridge to flex to the concave shape of the head, keeping the contact pressure even crossed the base of the bridge, the looser the head the more of a curve the bridge has to conform to. Neither the number of feet, nor the sizes of space between feet openings in the bridge base seem to affect the tone.

Some banjo bridges have string saddles, but this is optional. Likewise, some banjo bridges have an optional block of material positioned between the bridge and the strings, often this block is formed from a very hard material. A very hard substance will add to the brilliance, overtones and sustain of a note. Ebony, ivory, many plastics, and pearl is what is typically recommend in constructing a single large block or numerous individual blocks positioned under each string.

While all banjos and related instruments have a bridge, the configuration of the conventional banjo bridge has remained relatively unchanged for hundreds of years, and it is the purpose of the present invention to introduce a remarkable new change to banjo bridge configurations.

In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

SUMMARY OF THE INVENTION

The principle advantage of this invention is to provide a banjo bridge base plate configuration which significantly improved the overall sound quality produced by a banjo equipped with said inventive banjo bridge base.

Another advantage of this invention is to provide a banjo bridge base plate configuration which significantly improved the amplitude and tonal quality of the sound produced by a banjo equipped with said inventive banjo bridge base.

Another advantage of this invention is to provide a banjo bridge base plate configuration which enables the optimal use of nylon strings as well as steel strings on a banjo equipped with said inventive banjo bridge base.

Another object of this invention is to provide a banjo bridge base plate configuration which produces a less harsh and less "clangy" sound on a banjo equipped with said inventive banjo bridge base.

Another object of this invention is to provide a banjo bridge base plate configuration which produces more sustain on a banjo equipped with said inventive banjo bridge base.

Another object of this invention is to provide a banjo bridge base plate configuration which is easily installed on any existing banjo.

Another object of this invention is to provide a banjo bridge base plate configuration which is easily constructed of numerous materials including dense wood, light wood, ebony, ivory, many hard plastics, and pearl.

And yet another object of this invention is to provide a banjo bridge base plate configuration which can be provided in plain rectangular shapes or more fancy varying shapes as required in the design of banjo instruments.

And yet a further object of this invention is to provide a banjo bridge base plate configuration which enables banjo instruments to better blend with other instruments and acts to significantly eliminate mistakes and extraneous notes.

It must be clearly understood at this time although the preferred embodiment of the invention consists of the banjo bridge base plate, constructed of natural wood in a simple rectangle shaped form, or a fancy shaped form, that many conventional banjo bridge base making materials exist, including synthetic wood, plastics, ebony, ivory, pearl and like materials, or combinations thereof, that will achieve the a similar operational effect, as explained in detail below, and they will also be fully covered within the scope of this patent.

With respect to the above description then, it is to be realized that the optimum dimensional relationships for the parts of the invention, to include variations in size, materials, shape, form, function and manner of operation, assembly, installation and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
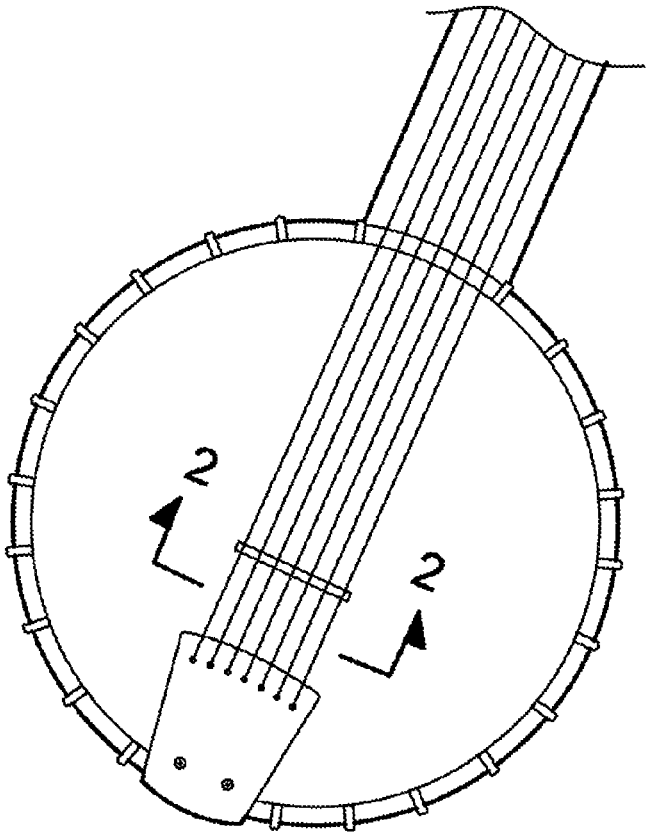
FIG. 1 PRIOR ART
FIG. 1 depicts a conventional modern banjo having a conventional bridge, making up the prior art.

For a fuller understanding of the nature and objects of the invention, reference should be had to the following detailed description taken in conjunction with the accompanying drawings wherein similar parts of the invention are identified by like reference numerals. There is seen in FIG. 1 a partial top plan view of conventional banjo instrument having a drum head, a neck, a tail, strings and a typical banjo bridge, whereby the strings are stung from the tail, where they are anchored, over the conventional bridge, and up the neck (partially shown) to be secured to friction tuning pegs or planetary gear tuners (not shown) for proper tuning.

Figure 2:
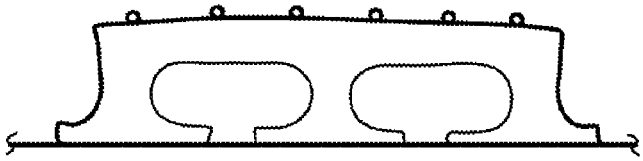
FIG. 2 PRIOR ART
FIG. 2 depicts a conventional banjo bridge making up the prior art.

FIG. 2 depicts a front view of a conventional prior art banjo bridge set in place between the drum head or pot surface of the banjo and the strings, here there are six strings shown.

Figure 3:
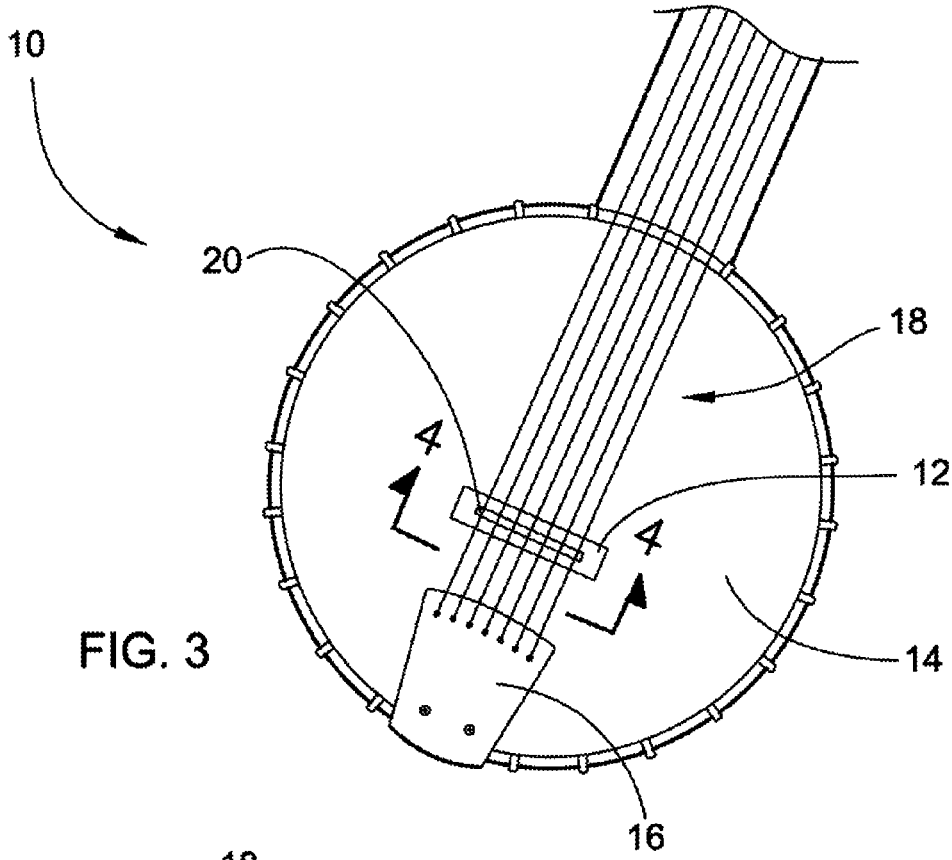
FIG. 3 depicts a conventional modern banjo having a conventional bridge with an inventive rectangular shaped bridge base plate in place under the conventional bridge.

FIG. 3 depicts a partial top plan view of conventional banjo instrument 10 having a drum head 14, a neck, a tail 16, strings 18 and a typical banjo bridge 20, whereby the strings are stung from the tail 16, where they are anchored, over the conventional bridge 20, and up the neck (partially shown) to be secured to friction tuning pegs or planetary gear tuners (not shown) for proper tuning. Here there is a banjo bridge base plate 12 that comprises the present invention. The bridge base plate 12 is in a simple rectangular shape as shown, but could be configured in any shape, including square, round, polygonal, and other varying shapes. The inventive bridge base plate 12 is installed between the conventional bridge and the banjo drum head surface.

Figure 4:
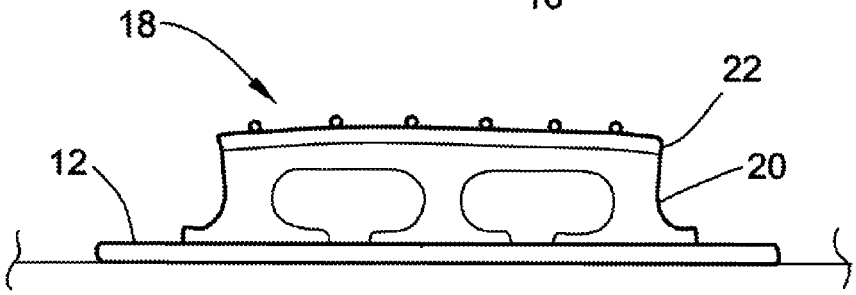
FIG. 4 depicts a front view of the banjo bridge having an inventive bridge base plate positioned between the head of the banjo and the bridge.

FIG. 4 depicts an enlarged front view of the inventive banjo bridge base plate 12 in place on the surface of the banjo drum head or pot, and in between the banjo drum head and the bridge 20. This bridge has an optional bridge crown material 22 between the bridge 20 and the strings 18.

Figure 5:
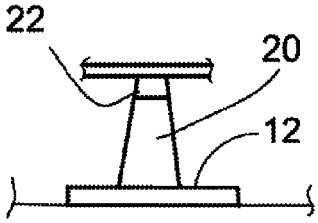
FIG. 5 depicts a side view of the banjo bridge having an inventive bridge base plate positioned between the head of the banjo and the bridge.

FIG. 5 depicts a side view of the inventive banjo bridge base plate 12 in place on the surface of the banjo drum head or pot, and in between the banjo drum head and the bridge 20. This bridge also has an optional bridge crown material 22 between the bridge 20 and the strings 18.

Figure 6:
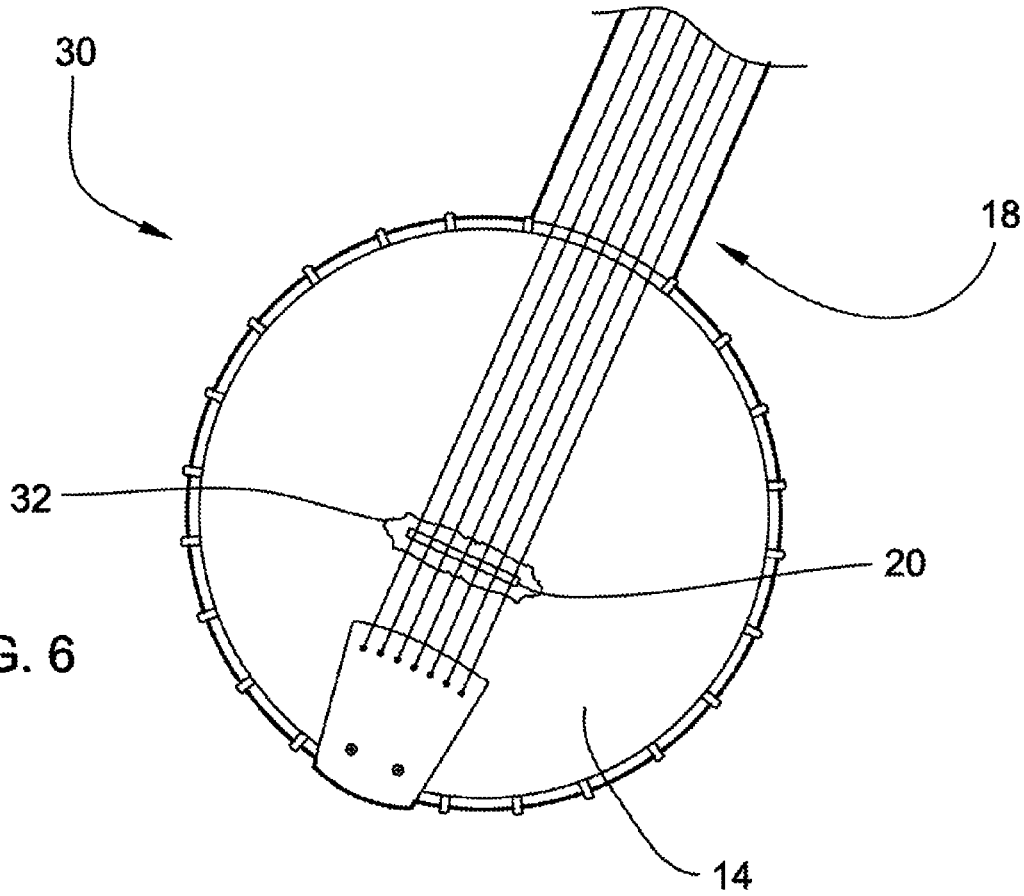
FIG. 6 depicts a conventional modern banjo having a conventional bridge with an inventive fancy shaped bridge base plate in place under the conventional bridge.

FIG. 6 depicts a partial top plan view of conventional banjo instrument 30 having a drum head 14, a neck, a tail, strings 18 and a typical banjo bridge 20, whereby the strings are stung from the tail, where they are anchored, over the conventional bridge 20, and up the neck (partially shown) to be secured to friction tuning pegs or planetary gear tuners (not shown) for proper tuning. Here, again there is a banjo bridge base plate 32 that comprises the present invention. This bridge base 32 is shown in a fancy irregular shape, but could be configured in any shape, including rectangular (as shown in FIG. 3) square, round, polygonal, and other varying shapes. The inventive bridge base plate 32 is installed between the conventional bridge and the banjo drum head surface. Often, builders/makers of banjo instruments will use this type of fancy decorative and ornamental shapes to adorn their banjos.

Figure 7:
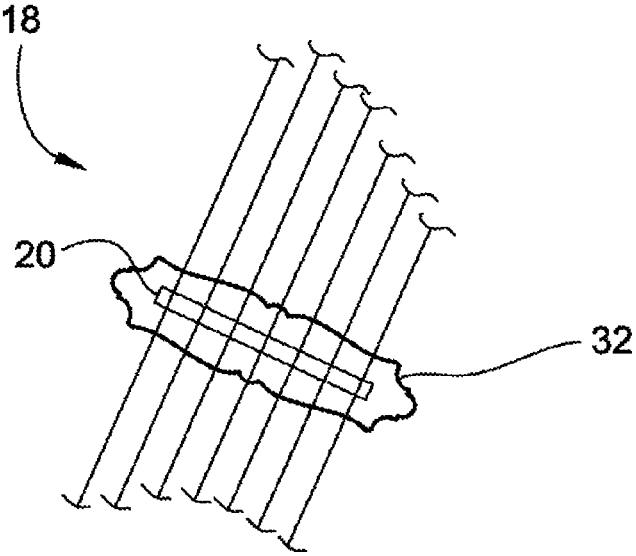
FIG. 7 depicts an enlarged view of an inventive fancy shaped bridge base plate in place under the conventional bridge.

FIG. 7 depicts an enlarged top plan view of the fancy irregular shaped bridge base plate 32 in place below the typical standard banjo bridge 20 having strings 18 strung on the banjo bridge 20. Upon installation of the inventive bridge base plate, the inventors realized the following unexpected results:

(a) the banjo bridge base configuration significantly improved the overall sound quality produced by the banjo so equipped;

(b) the banjo bridge base configuration significantly improved the amplitude (loudness) and tonal quality of the sound produced by the banjo so equipped;

(c) the banjo bridge base configuration enabled the optimal use of nylon strings as well as, or in place of steel strings on a banjo so equipped;

(d) the banjo bridge base configuration produced a less harsh and less "clangy" sound on a banjo so equipped;

(e) the banjo bridge base configuration produced more sustain on a banjo so equipped; and (f) the banjo bridge base configuration enabled banjo instruments to better blend with other instruments by acting to significantly eliminate mistakes and extraneous notes generated during playing of the instrument.

The inventive banjo bridge base plate 12 and 32 shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed for providing an inventive banjo bridge base plate 12 and 32 in accordance with the spirit of the invention, and such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A separate tone plate bridge base mechanical string energy initial peak compression device for a banjo comprising:

a) a separate tone flat plate positioned between the banjo drum head and the banjo bridge which is retrofitted beneath the banjo bridge; and wherein said separate tone flat plate acts as a limiter to initial peak energy coming from the strings when the banjo is played for the purpose of increasing the level of energy released during sustain time enabling a banjo player to play music with increased sustain, thereby enabling a broader general use of the instrument.

2. The separate tone plate bridge base mechanical string energy initial peak compression device for a banjo, according to claim 1, wherein said flat plate is rectangular in shape.

3. The separate tone plate bridge base mechanical string energy initial peak compression device for a banjo, according to claim 1, wherein said flat plate is irregularly shaped in order to distribute flexibility to said flat plate.

4. The separate tone plate bridge base mechanical string energy initial peak compression device for a banjo, according to claim 1, wherein said flat plate is constructed of wood.

5. The separate tone plate bridge base mechanical string energy initial peak compression device for a banjo, according to claim 1, wherein said flat plate is constructed of synthetic wood.

6. The separate tone plate bridge base mechanical string energy initial peak compression device for a banjo, according to claim 1, wherein said flat plate is constructed of plastic.

7. The separate tone plate bridge base mechanical string energy initial peak compression device for a banjo, according to claim 1, wherein said flat plate is constructed of ebony.

8. The separate tone plate bridge base mechanical string energy initial peak compression device for a banjo, according to claim 1, wherein said flat plate is constructed of ivory.

9. The separate tone plate bridge base mechanical string energy initial peak compression device for a banjo, according to claim 1, wherein said flat plate is constructed of pearl.

10. The separate tone plate bridge base mechanical string energy initial peak compression device for a banjo, according to claim 3, wherein said irregularly shaped flat plate includes a fanciful decorative shape.

11. A method for making a separate tone plate bridge base mechanical string energy initial peak compression device for a banjo comprising the steps of:

a) providing a separate tone flat plate positioned between the banjo drum head and the banjo bridge which is retrofitted beneath the banjo bridge; and wherein said separate tone flat plate acts as a limiter to initial peak energy coming from the strings when the banjo is played for the purpose of increasing the level of energy released during sustain time enabling a banjo player to play music with increased sustain, thereby enabling a broader general use of the instrument.

12. The method for making a separate tone plate bridge base mechanical string energy initial peak compression device for a banjo, according to claim 11, wherein said provided flat plate is rectangular in shape.

13. The method for making a separate tone plate bridge base mechanical string energy initial peak compression device for a banjo, according to claim 11, wherein said provided flat plate is irregularly shaped in order to distribute flexibility to said flat plate.

14. The method for making a separate tone plate bridge base mechanical string energy initial peak compression device for a banjo, according to claim 11, wherein said provided flat plate is constructed of wood.

15. The method for making a separate tone plate bridge base mechanical string energy initial peak compression device for a banjo, according to claim 11, wherein said flat plate is constructed of synthetic wood.

16. The method for making a separate tone plate bridge base mechanical string energy initial peak compression device for a banjo, according to claim 11, wherein said flat plate is constructed of plastic.

17. The method for making a separate tone plate bridge base mechanical string energy initial peak compression device for a banjo, according to claim 11, wherein said flat plate is constructed of ebony.

18. The method for making a separate tone plate bridge base mechanical string energy initial peak compression device for a banjo, according to claim 11, wherein said flat plate is constructed of ivory.

19. The method for making a separate tone plate bridge base mechanical string energy initial peak compression device for a banjo, according to claim 11, wherein said flat plate is constructed of pearl.

20. The method for making a separate tone plate bridge base mechanical string energy initial peak compression device for a banjo, according to claim 13, wherein said flat irregularly shaped plate includes a fanciful decorative shape.

* * * * *